US007377568B2

(12) United States Patent
Moses

(10) Patent No.: US 7,377,568 B2
(45) Date of Patent: May 27, 2008

(54) PROMOTIONAL SHOPPING-BAG HANDLE WITH HINGED BAG GRIPPING MEMBERS

(75) Inventor: Joel V. Moses, Bait Shemesh (IL)

(73) Assignee: Adbaggers LLC, Brooklyn, NY (US)

( * ) Notice: Subject to any disclaimer, the term of this patent is extended or adjusted under 35 U.S.C. 154(b) by 0 days.

(21) Appl. No.: 11/145,757

(22) Filed: Jun. 6, 2005

(65) Prior Publication Data

US 2005/0224536 A1 Oct. 13, 2005

Related U.S. Application Data

(63) Continuation-in-part of application No. 10/387,696, filed on Mar. 13, 2003, now abandoned.

(51) Int. Cl.
*B65D 33/06* (2006.01)
*A45F 3/10* (2006.01)

(52) U.S. Cl. ..... 294/170; 294/137; 224/257

(58) Field of Classification Search ..... 294/137, 294/170, 159, 171; 224/257
See application file for complete search history.

(56) References Cited

U.S. PATENT DOCUMENTS 63,086 A * 3/1867 Peebels ..... 294/137
606,936 A * 7/1898 Ottignon ..... 294/137
3,251,622 A * 5/1966 Miller ..... 294/33
3,297,350 A * 1/1967 Hidding ..... 294/33
D222,767 S * 12/1971 Alfano ..... D9/434
3,756,395 A * 9/1973 Ganz ..... 206/432
3,796,357 A * 3/1974 Johnson ..... 294/170
4,185,375 A * 1/1980 Brown ..... 206/446
5,440,785 A * 8/1995 McDonald ..... 294/158
5,558,326 A * 9/1996 Adamson et al. ..... 473/563
6,045,019 A * 4/2000 Moses ..... 294/170

* cited by examiner

*Primary Examiner*—Saul J. Rodriguez
*Assistant Examiner*—Paul T Chin
(74) *Attorney, Agent, or Firm*—Lackenbach Siegel, LLP; Myron Greenspan

(57) ABSTRACT

A promotional shopping-bag handle with hinged bag-gripping members contains a strap that includes an elongate sheet of material with two end portions and a central portion. Each end portion has a hook configured to receive the plastic handles of a shopping bag or the like. The strap may be plastic injection molded; it may be of uniform thickness throughout or selectively reduced in thickness to save material and weight in areas where extra bulk is not essential to the strap's function. Hinges provided between the central and end portions allow the end portions to deflect out of the plane of the central portion under the weight of the bags being supported. This allows the bag holder to respond to the weight of the bags while holding a central portion that is substantially flat, thus avoiding bending, compression and pain to the hand of the user.

23 Claims, 1 Drawing Sheet

PROMOTIONAL SHOPPING-BAG HANDLE WITH HINGED BAG GRIPPING MEMBERS

CROSS-REFERENCE TO RELATED APPLICATION

This application is a continuation-in-part of U.S. patent application Ser. No. 10/387,696 filed on Mar. 13, 2003 now abandoned for Shopping bag handle, currently pending.

BACKGROUND OF THE INVENTION

1. Field of the Invention

The invention generally relates carrying devices and, more specifically, to a promotional shopping bag handle.

2. Background of the Invention

Paper bags, commonly used for many years in food shops and supermarkets, have been supplanted in most establishments with plastic bags provided with opposing openings which form hand gripping portions or handles. However, while used almost universally, such plastic bags tend to have smaller capacity than the paper variety and any significant purchase invariably results in multiple such bags being packed. Also, when heavy items, such as cans or bottles, are packed the handles gather and stretch to form relatively thin bands which apply substantial forces concentrated along narrow areas or regions of the hand, which can be painful when the bags are carried over for any period of time or distance.

In U.S. Pat. No. 6,045,019 a strap for carrying shopping bags by hand or on a shoulder is disclosed that is made of a relatively thin sheet of flat material that includes a central portion dimensioned to be gripped by the hand and a pair of opposing spaced hooks at each end of the central portion. The hooks and the central portion are essentially formed of the same thickness material all arranged in the same plane. Thus, when the bags at the opposite ends pull downwardly on the hooks the entire strap bends out of the plane into an arcuate shape. Such bending of the central portion renders the device difficult and uncomfortable to hold as it squeezes or presses on opposite sides of the hand. When very heavy bags are carried bending becomes excessive and the resulting compression of the hand can become painful.

SUMMARY OF THE INVENTION

It is an object of the invention to provide a strap for facilitating carrying shopping bags by hand.

It is another object of the invention to provide a strap as in the previous object which is simple in construction and economical to manufacture.

It is still another object of the invention to facilitate carrying of multiple filled plastic shopping bags with minimum effort and maximum comfort.

It is a further object to provide a strap of the type above suggested that can be used to carry plastic shopping bags, or the like, by hand without squeezing or compressing it while distributing the forces of the weight to minimize the discomfort or pain typically encountered when carrying such bags directly by hand.

It is yet a further object of the invention to provide a strap of the type under discussion that is particularly suitable for displaying one or more advertisements on one or both sides thereof either by being directly printed on the strap or by being printed on a transparent or opaque sleeve or sheet of material that wraps around the central portion of the strap.

In order to achieve the above objects, as well as others which will become evident to those skilled in the art, a strap for carrying shopping bags or the like by hand is made of a relatively thin elongate sheet of material that defines a longitudinal axis and which is flexible at least along its length direction or axis. A central portion is dimensioned and configured to be gripped by the hand and extend to each side thereof. An end portion is provided at each end of the central portion and formed with gripping means for engaging and retaining the handle formed in a plastic shopping bag. In one form, the gripping portions comprise hook-like members having lateral openings or cutouts on each end portion that receive the shopping bag handles but resist their removal when supported bags on said end portions are pulled in opposite directions. An important feature of the invention is that a plastic hinge is provided between each end portion and the central portion, so that supporting heavy bags on each of the end portions or hooks deflects these out of the plane without materially bending the central portion. The central portion, therefore, remains substantially flat and easy to hold without squeezing the hand of the user. Also, a shrink wrap sleeve covering the central portion of the strap can be used to display one or more a advertisements. The sleeve is preferably pre-printed prior to application about the strap although it can be printed after it is placed on the strap.

DESCRIPTION OF THE PREFERRED EMBODIMENT

Figures 1, 2, 3, 4, 5, 6, 7, 8:
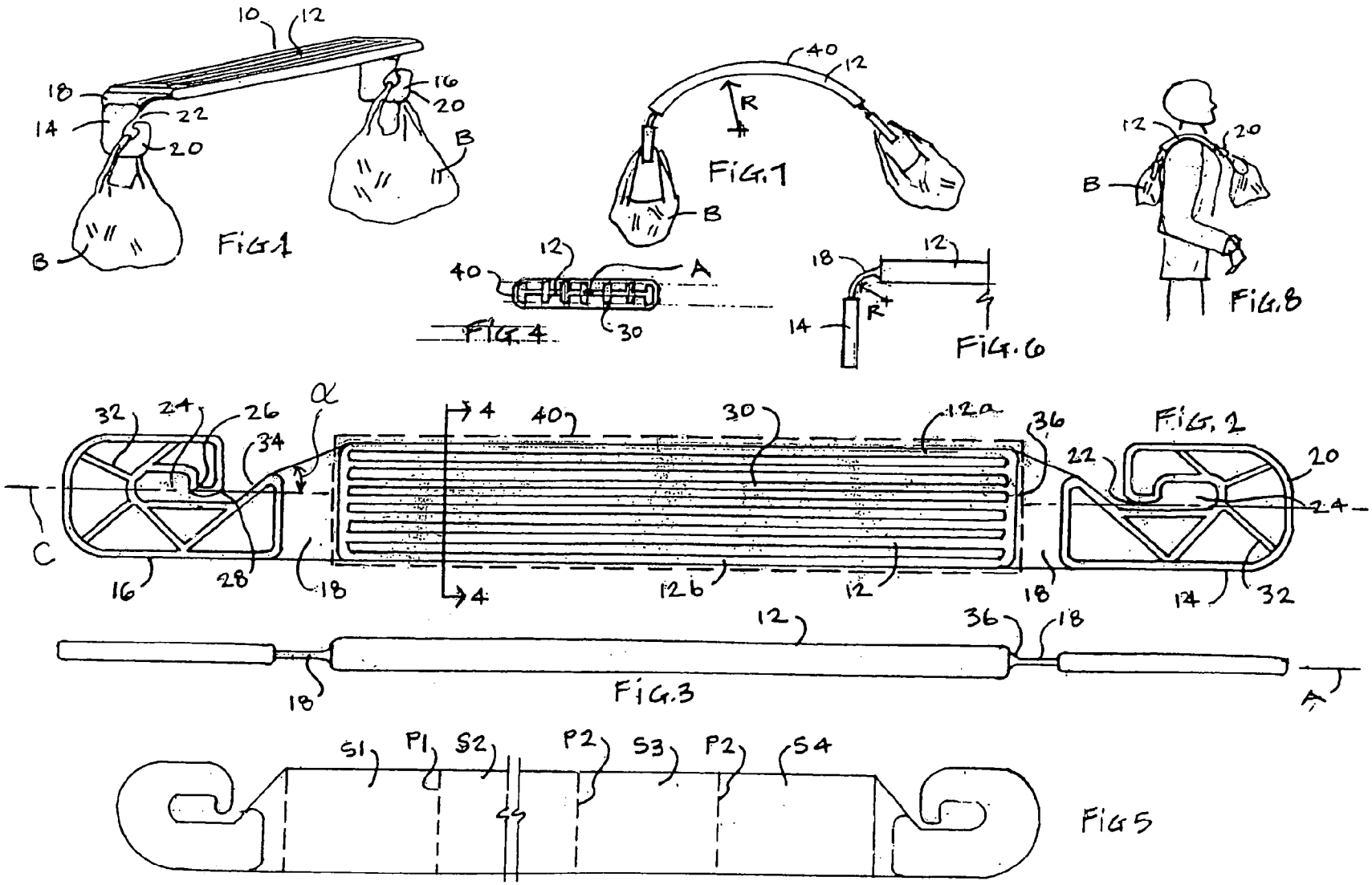
FIG. 1 illustrates the manner in which two plastic shopping bags are placed on the strap of the invention prior to use.
FIG. 2 is a top plan view of a strap in accordance with the invention.
FIG. 3 is a side elevational view of the strap shown in FIG. 2.
FIG. 4 is a cross-sectional view of the strap shown in FIG. 2, taken along line 4-4.
FIG. 5 is similar to FIG. 2 but shown with the shrink-wrapped sleeve imprinted with a plurality of panels suitable for displaying advertisements.
FIG. 6 is a fragmented view of one end of the handle when a load is applied to one of the engaging members or hooks.
FIG. 7 is a diagrammatic view of the handle as it assumes a flexed condition when held by a hand or supported on a shoulder of a user.
FIG. 8 is similar to FIG. 7 but when placed on a shoulder of a user.

Referring to FIG. 1, one embodiment of the shopping bag handle in accordance with the invention is generally designated by the reference numeral 10.

The handle 10 is made of a generally flat strip of material that defines a handle axis A (FIGS. 3 and 4). The strip is shown to be generally rectangular in shape although the specific configuration is not critical. The handle 10 includes a central portion 12 configured to be comfortably held by a user. At axial ends of the central portion 12 there are provided spaced engaging or gripping members 14, 16 that extend beyond the central portion and can be positioned in the plane of the central portion 12 or can be moved out of that plane, as shown in FIG. 1. This is achieved by providing a plastic hinge 18 at each axial end between the central portion 12 and a depending member 14, 16 as best shown in FIGS. 2 and 3. As used in this application, the plastic hinge

18 is an integrally formed pliable hinge that is generally a flat flexible portion having a thickness less than the thickness of the central portion to form a cantilevered beam that defines a radius "r" (FIG. 6) on bending smaller than a radius "R" defined by the central portion 12 (as suggested in FIG. 7). However, the properties of the central portion 12 are preferably selected to also allow the central portion to bend to a degree to generally conform to the curvature of the user when the strap is placed on the shoulder with loads applied as suggested in FIG. 8.

The strap 10 may be formed of any thin sheet of non-brittle and non-rigid material. Although various materials may be used, as to be described, the material used should be sufficiently flexible at least along the length direction or in the direction of the axis A to remain relatively flat so as to avoid excessive compressive forces on the hand of the user due to bending or flexing. Polypropylene or polyethylene may be used for the straps, although other plastics or other suitable materials may also be used, with different degrees of advantage. The strap 10 including the central portion 12 has lateral edges 12*a*, 12*b* which is dimensioned and configured to be gripped by the hand. The edges can be straight as shown or provided with arcuate recesses or curvatures dimensioned to at least partially receive the fingers of a user.

In FIGS. 1, 6, 7 the strap 10 is shown as it would normally be used to support at least two bags B. It will be noted that the strap 10 conforms, under the weight of the bags B, to bend or deflect the depending engaging members 14, 16 out of the plane of the central portion 12 to positions as shown in which the depending members can assume orientations as little as 90 degree or less to the central portion.

The axial length of the strap 10 is not critical although the length should be selected to position the bags being carried at a comfortable height at the front and rear of the user. It has been found, for example, that an overall length equal of about 8.5" is suitable, although different lengths may be used to accommodate the size and/or height of the user. The central portion may be about 4.5" long and ergonomically shaped to maximize comfort and minimize high stress concentrations on the hand.

In the broadest aspects of the invention the central portion is provided at the axial end thereof with spaced engaging members or gripping means for engaging and retaining a handle formed in a plastic shopping bag. Such gripping means can take any form which will suitably and selectively grip a shopping bag and retain it. Therefore, such gripping means may include clips or the like. However, in the presently preferred embodiments, such gripping means are in the form of a hook 20 defining a lateral cutout or passageway 22 generally along or proximate to the axis A, which receive the shopping bag handles within an opening 24 but resists their removal when supported bags on depending engaging members are pulled in opposite directions, as suggested in FIG. 1.

To facilitate the insertion of the bag handles into the openings 24 the hooks 20 are preferably provided with rounded corners 26, 28. To enhance the rigidity of the central portion while minimizing the weight and the amount of material used there are preferably provided longitudinal ribs 30 on one or preferably both sides of the central portion 12 as shown in FIGS. 2. and 4 The same is true of the depending engaging members 14, 16 which are provided with any suitable array of ribs 32. However, the surfaces of the hooks 20 may be solid and without ribs, as shown in FIG. 5. Any suitable number of elongate recesses or grooves that form the ribs 32 may be provided for any given application.

To facilitate the insertion of the bag handles into the narrow passageway 22 an inclined edge 34 is preferably provided which extends from the central portion 12, along the hinge 18 and the initial portion of the depending members 14, 16. The inclined edge 34 forms an angle $\alpha$ with a longitudinal axis c (FIG. 2), which may be co-extensive with axis A shown in FIG. 3. This assists to guide the bag handles to and through the narrow passageway 22 with minimal effort by the user.

Preferably, a slight radius 36 (FIG. 3) is provided where the hinges 18 meet the central portion 12 to strengthen the connection and resist the significant stresses that can result at such connection points when heavy bags are supported by the handle. It is to be understood that the present invention is not limited to the embodiment described above, but encompasses any and all embodiments within the scope of the invention.

As shown in FIGS. 2, 4 and 5, another feature of the invention is the placement of a slightly oversized elongate shrinkable tubular sleeve 40 to surround the central portion 12, after which the sleeve can be heated to shrink, in a well-known manner, to tightly secure the sleeve over the central portion so as to prevent relative movements thereof in relation to the handle in the direction of the axis A. The sleeve is preferably pre-printed with advertising text, graphics, logos, trademarks, services marks and the like in one or more of the panels or sections S1-S4. Of course, larger ads can be imprinted over two or more panels or sectors, and can be printed on one or both sides of the handle.

Typically, the shrink-wrap plastics are somewhat pliable and stretchable. Preferably, the parameters or properties of the central portion are selected to limit the degree of bending substantially beyond what is needed to conform to the curvature of the shoulder, as suggested. This also has the advantage of limiting the degree of stretching and deformation of the shrink-wrapped sleeve and thereby prevent splitting or cracking of the sleeve during the use of the straps. When used over the ribs 32, the shrink-wrap sleeve also protects the hand of the user by covering the ribs and associated recesses that might otherwise press against and cause pain to the hand of the user.

I claim:

1. Strap for carrying at least two shopping bags by hand comprises a relatively thin sheet of elongate material which defines a plane and a longitudinal axis within said plane in a flat unloaded condition of said elongate sheet of material including a substantially rigid central portion, dimensioned and configured to be gripped by the hand of a user; a pair of spaced engaging members initially arranged within said plane in the unloaded condition and including receiving means substantially co-extensive with said axis for receiving handles of a pliable shopping bag from a predetermined position offset from said axis to a point substantially co-extensive with said axis, said plane defining a substantially vertical plane during an initial loading phase when shopping bag handles are introduced into said receiving means of said engaging members, and defining a substantially horizontal plane during a carrying phase prior to deformation by loads applied to said engaging members by bags; and a pliable hinge between said central portion and each engaging member that permits said engaging members to be in said plane of said central portion before loads are applied or move out of said plane relative to said central portion in said carrying phase in response to loads applied to said engaging members, said pliable hinge comprising a generally flat flexible portion having a thickness less than the thickness of said central portion that defines a radius on bending smaller than a radius defined by said central portion upon application of a load on said engaging members in said carrying phase, said pliable hinge including a guide edge inclined relative to a longitudinal axis for guiding a shopping bag handle from said offset position along said central portion towards said axis during said initial loading phase to facilitate insertion of said shopping bag handle into said receiving means, whereby supporting shopping bags on each engaging member facilitates the carrying of the shopping bags with comfort by allowing said engaging members to assume positions during said carrying phase consistent with the weight of the bags while maintaining the central portion relatively flat so as to avoid compressive or squeezing forces on the hand of the user due to excessive flexing or bending of the central portion.

2. Strap as defined in claim 1, wherein said pair of spaced engaging members comprises a lateral hook at each end of said central portion.

3. Strap as defined in claim 1, wherein each pliable hinge is integrally formed with said central portion and said engaging member.

4. Strap as defined in claim 1, further comprising shrinkable cylindrical sleeve surrounding said central portion that resists splitting when caused to bend out of said plane with bending of said central portion.

5. Strap as defined in claim 4, wherein said sleeve is imprinted with at least one advertisement.

6. Strap as defined in claim 4, wherein said sleeve is transparent.

7. Strap as defined in claim 4, wherein said sleeve is opaque.

8. Strap as defined in claim 1, wherein the material and thickness of said central portion are selected to allow said central portion to only bend to a degree to substantially conform to the shape of a shoulder of a user when the strap is placed on the shoulder with one engaging member in front of the user and one engaging member in the back of the user with loads applied to said engaging members.

9. Strap as defined in claim 1, wherein said central portion is provided with at least one elongate groove or recess extending along the elongate direction of a planar surface of said central portion.

10. Strap as defined in claim 9, wherein a plurality of generally parallel grooves or recesses are provided to form a plurality of spaced ribs.

11. Strap as defined in claim 10, further comprising a cylindrical sleeve that is shrink-wrapped about said central portion to cover and protect the hand of a user from direct contact with said ribs.

12. Strap as defined in claim 1, wherein said guide edge is substantially a straight edge inclined relative to said axis.

13. Strap as defined in claim 12, wherein said hinge substantially defines a trapezoid within said plane prior to application of loads.

14. Strap as defined in claim 1, wherein said pliable hinge defines a cantilever beam having a fixed end connected to said central portion and supporting an associated engaging member at a free end thereof, and having more material at said fixed end to strengthen said pliable hinge against bending or deformation during said loading phase when said plane is arranged in said vertical plane.

15. Strap as defined in claim 1, wherein each receiving means includes an opening that provides a minimal access clearance for the handles of plastic bags to move into said openings, whereby forced insertion of the handles of the plastic bags through said access clearances into said openings minimizes the risk of the handles from inadvertently separating from the strap.

16. Strap for carrying at least two shopping bags by hand comprises a relatively thin sheet of elongate material which defines a plane and a longitudinal axis within said plane in a flat unloaded condition of said elongate sheet of materials including a substantially rigid central portion, dimensioned and configured to be gripped by the hand of a user; a pair of spaced engaging members at each axial end of said central portion each including receiving means substantially coextensive with said axis for receiving a handle of a pliable shopping bag, said plane defining a substantially vertical plane during an initial loading phase when shopping bag handles are introduced into said receiving means of said engaging members, and defining a substantially horizontal plane during a carrying phase prior to deformation by loads applied to said engaging members by the bags; and a pliable hinge between said central portion and each engaging member that permits said engaging members to be in said plane of said central portion during said loading phase before loads are applied or move out of said plane relative to said central portion in said carrying phase in response to loads applied to said engaging members, said pliable hinge comprising a generally flat flexible portion having a thickness less than the thickness of said central portion to define a radius on bending smaller than a radius defined by said central portion during said carrying phase upon application of a load on said engaging members, and said pliable hinge having a length along the direction of said longitudinal axis which is less than a minimum dimension of said pliable hinge along a direction normal to said longitudinal axis to form a substantially rigid structure and substantially avoid any bending during said loading phase when bag handles are introduced into said engaging members and having a guide edge inclined to a longitudinal axis for guiding a shopping bag handle from said offset position along said central portion towards said axis during said initial loading phase to facilitate insertion of said shopping bag handle into said receiving means, whereby bag handles can be readily guided and introduced into said engaging members during said loading phase when the strap is substantially rigid and when said plane is arranged in a vertical plane, and supporting shopping bags on each engaging member facilitates the carrying of the shopping bags with comfort by allowing said end portions to assume positions outside said plane during said carrying phase consistent with the weight of the bags while maintaining the central portion relatively flat to avoid compression or squeezing forces on the hand of the user due to excessive flexing or bending of the central portion, or undesired flexing or pivoting movements of said engaging members.

17. Strap as defined in claim 16, wherein each pliable hinge has a length direction which is approximately one half of the maximum dimension of said pliable hinge along a direction normal to said axis.

18. Strap for carrying at least two shopping bags by hand comprising a relatively thin sheet of elongate material which defines a plane and a longitudinal axis within said plane in a flat unloaded condition of said elongate sheet of material including a substantially rigid central portion, dimensioned and configured to be gripped by the hand of a user; a pair of spaced engaging members including receiving means for receiving a handle of a pliable shopping bag; pliable hinge between said central portion and each end portion that permits said engaging members to be in the plane of said central portion before loads are applied or move out of said plane in response to loads applied to said engaging members, said pliable hinge comprising a generally flat flexible portion having a thickness less than the thickness of said central portion to form a step of reduced thickness at each axial end where said central portion makes a transition to a pliable hinge and having a guide edge inclined to a longitudinal axis for guiding a shopping bag handle from said offset position along said central portion towards said axis during said initial loading phase to facilitate insertion of said shopping bag handle into said receiving means; and a shrink-wrap sleeve surrounding said central portion and having an axial length greater than the axial length of said central portion to position said sleeve to extend beyond both of said steps of reduced thickness to engage the same and prevent axial shifting or movements following the shrinking of said shrink-wrap sleeve.

19. Strap as defined in claim 18, wherein said sleeve is imprinted with at least one advertisement.

20. Strap as defined in claim 18, wherein said sleeve is transparent.

21. Strap as defined in claim 18, wherein said sleeve is opaque.

22. Strap for carrying at least two shopping bags by hand comprises a relatively thin sheet of elongate material which defines a plane and a longitudinal axis within said plane in a flat unloaded condition of said elongate sheet of materials including a substantially rigid central portion, dimensioned and configured to be gripped by the hand of a user; a pair of spaced engaging members of each axial end of said central portion including receiving means for receiving a handle of a pliable shopping bag; and a pliable hinge between said central portion and each engaging member that permits said engaging members to be in the plane of said central portions before loads are applied or move out of said plane in response to loads applied to said engaging members, said pliable hinge comprising a generally flat flexible portion having a thickness less than the thickness of said central portion that defines a radius on bending smaller than a radius defined by said central portion upon application of a load on said engaging members, and said pliable hinge having a length along the direction of said longitudinal axis which is less than a minimum dimension of said pliable hinge along a direction normal to said longitudinal axis and having a guide edge inclined to a longitudinal axis for guiding a shopping bag handle from said offset position along said central portion towards said axis during said initial loading phase to facilitate insertion of said shopping bag handle into said receiving means, whereby supporting shopping bags on each engaging member facilitates the carrying of the shopping bags with comfort by allowing said end portions to assume positions consistent with the weight of the bags while maintaining the central portion relatively flat to avoid compression or squeezing forces on the hand of the user due to excessive flexing or bending of the central portion, wherein each receiving means includes an opening that provides a minimal access clearance for the handles of plastic bags to move into said openings, whereby forced insertion of the handles of the plastic bags through said access clearances into said openings minimizes the risk of the handles from inadvertently separating from the strap.

23. Strap for carrying at least two shopping bags by hand comprises a relatively thin sheet of elongate material which defines a plane and a longitudinal axis within said plane in a plat unloaded condition of said elongate sheet of material including a substantially rigid central portion, dimensioned and configured to be gripped by the hand of a user; a pair of spaced engaging members including receiving means substantially extensive with said axis for receiving handles of a pliable shopping bag from a predetermined direction to a point substantially co-extensive with said axis; and a pliable hinge between said central portion and each engaging member that permits said engaging members to be in the plane of said central portion before loads are applied or move out of said plane in response to loads applied to said engaging members, said pliable hinge comprising a generally flat flexible portion having a thickness less than the thickness of said central portion that defines a radius on bending smaller than a radius defined by said central portion upon application of a load on said engaging members, said pliable hinge including a guide edge inclined relative to said axis for guiding a shopping bag handle from said central portion towards said axis to facilitate insertion of said shopping bag handle into said receiving means, whereby supporting shopping bags on each engaging member facilitates the carrying of the shopping bags with comfort by allowing said engaging members to assume positions consistent with the weight of the bags while maintaining the central portion relatively flat so as to avoid compressive or squeezing forces on the hand of the user due to excessive flexing or bending of the central portion, wherein each receiving means includes an opening that provides a minimal access clearance for the handles of plastic bags to move into said openings, whereby forced insertion of the handles of the plastic bags through said access clearances into said openings minimizes the risk of the handles from inadvertently separating from the strap.

* * * * *